US008006847B2

(12) United States Patent
Blaha et al.

(10) Patent No.: US 8,006,847 B2
(45) Date of Patent: Aug. 30, 2011

(54) CHIP SORTING DEVICE

(75) Inventors: Ernst Blaha, Tullnerbach (AT); Peter Krenn, Neufeld (AT)

(73) Assignee: Shuffle Master GmbH & Co KG, Vienna (AT)

( * ) Notice: Subject to any disclaimer, the term of this patent is extended or adjusted under 35 U.S.C. 154(b) by 471 days.

(21) Appl. No.: 11/590,340

(22) Filed: Oct. 30, 2006

(65) Prior Publication Data

US 2007/0102330 A1 May 10, 2007
US 2011/0005983 A9 Jan. 13, 2011

Related U.S. Application Data

(63) Continuation of application No. 11/004,006, filed on Dec. 3, 2004, which is a continuation of application No. PCT/AT03/00149, filed on May 26, 2003.

(30) Foreign Application Priority Data

Jun. 5, 2002 (AT) ..... GM359/2002

(51) Int. Cl.
*G07D 5/00* (2006.01)

(52) U.S. Cl. ..... 209/651; 453/13; 453/15; 453/33; 453/44; 453/45

(58) Field of Classification Search ..... 194/200, 194/201; 209/576, 580, 651, 652, 686; 453/6, 453/10, 12, 13, 15, 33, 44, 45, 49
See application file for complete search history.

(56) References Cited

U.S. PATENT DOCUMENTS 1,813,296 A 7/1931 Kidwell
1,947,456 A 2/1934 Bock
2,020,293 A 11/1935 Adelstein
2,904,151 A 9/1959 Johnson
3,143,118 A * 8/1964 Haines ..... 453/13
3,371,761 A 3/1968 Ryo
3,435,833 A 4/1969 Tanaka
3,583,410 A 6/1971 Bayha et al.
3,680,566 A 8/1972 Tanaka et al.
3,766,452 A 10/1973 Burpee et al.

(Continued)

FOREIGN PATENT DOCUMENTS

AT 006 405 10/2003

(Continued)

OTHER PUBLICATIONS

International Search Report dated Mar. 6, 2008, for International Application No. PCT/EP2007/008873 (3 pages).

(Continued)

*Primary Examiner* — Joseph C Rodriguez
(74) *Attorney, Agent, or Firm* — TraskBritt

(57) ABSTRACT

A casino chip sorting device may comprise a transport disc, a drive, an ejector, a cam, and a blade. The drive may be operably coupled to the transport disc, for rotating the transport disc, and the transport disc may have multiple recesses for collecting individual chips. The ejector may be extendable into a recess from beneath the transport disc to move a disc that is in the recess and the cam may be selectively rotatable by the drive to push the ejector into the recess. The blade may have an upper surface positioned to receive a casino chip moved by the ejector. Additionally, a processor associated with the casino chip sorting device may be programmed to recognize a jam.

20 Claims, 4 Drawing Sheets

U.S. PATENT DOCUMENTS

| | | | | |
|---|---|---|---|---|
| 3,771,538 | A | | 11/1973 | Reis |
| 3,827,582 | A | | 8/1974 | Lederer |
| 4,157,139 | A | | 6/1979 | Björk |
| 4,161,381 | A | | 7/1979 | Sciortino |
| 4,209,960 | A | | 7/1980 | Deutschländer et al. |
| 4,275,751 | A | | 6/1981 | Bergman |
| 4,360,034 | A | | 11/1982 | Davila et al. |
| 4,531,531 | A | | 7/1985 | Johnson et al. |
| 4,543,969 | A | | 10/1985 | Rasmussen |
| 4,607,649 | A | | 8/1986 | Taipale et al. |
| 4,681,128 | A | | 7/1987 | Ristvedt et al. |
| 4,731,043 | A | | 3/1988 | Ristvedt et al. |
| 4,775,354 | A | | 10/1988 | Rasmussen et al. |
| 4,863,414 | A | | 9/1989 | Ristvedt et al. |
| 4,966,570 | A | | 10/1990 | Ristvedt et al. |
| 5,011,455 | A | | 4/1991 | Rasmussen |
| 5,011,456 | A | | 4/1991 | Kobayashi et al. |
| 5,022,889 | A | | 6/1991 | Ristvedt et al. |
| 5,042,810 | A | | 8/1991 | Williams |
| 5,141,443 | A | | 8/1992 | Rasmussen et al. |
| 5,166,502 | A | | 11/1992 | Rendleman et al. |
| 5,207,612 | A | | 5/1993 | Wollaston |
| 5,277,651 | A | | 1/1994 | Rasmussen et al. |
| 5,406,264 | A | | 4/1995 | Plonsky et al. |
| 5,460,295 | A | | 10/1995 | Law |
| 5,472,074 | A | | 12/1995 | Milcetic |
| 5,531,331 | A | | 7/1996 | Barnett |
| 5,551,542 | A | | 9/1996 | Stockli |
| 5,624,308 | A | | 4/1997 | Rumbach |
| 5,651,548 | A | | 7/1997 | French et al. |
| 5,735,742 | A | | 4/1998 | French |
| 5,755,618 | A | | 5/1998 | Mothwurf |
| 5,757,876 | A | * | 5/1998 | Dam et al. ..... 377/7 |
| 5,770,533 | A | | 6/1998 | Franchi |
| 5,781,647 | A | | 7/1998 | Fishbine et al. |
| 5,827,117 | A | | 10/1998 | Naas |
| 5,836,583 | A | | 11/1998 | Towers |
| 5,865,673 | A | | 2/1999 | Geib et al. |
| 5,895,321 | A | | 4/1999 | Gassies et al. |
| 5,931,732 | A | | 8/1999 | Abe et al. |
| 5,933,244 | A | | 8/1999 | Kiritchenko |
| 5,947,257 | A | | 9/1999 | Schwartz |
| 5,950,796 | A | | 9/1999 | Kobayashi |
| 5,957,262 | A | * | 9/1999 | Molbak et al. ..... 194/200 |
| 5,957,776 | A | | 9/1999 | Hochne |
| 6,021,949 | A | | 2/2000 | Boiron |
| 6,075,217 | A | | 6/2000 | Kiritchenko |
| 6,080,056 | A | | 6/2000 | Karlsson |
| 6,168,001 | B1 | * | 1/2001 | Davis ..... 194/200 |
| 6,186,895 | B1 | | 2/2001 | Oliver |
| 6,193,599 | B1 | | 2/2001 | Kurosawa et al. |
| 6,260,757 | B1 | | 7/2001 | Strisower |
| 6,264,109 | B1 | | 7/2001 | Chapet et al. |
| 6,283,856 | B1 | | 9/2001 | Mothwurf |
| 6,296,190 | B1 | | 10/2001 | Rendleman |
| 6,313,871 | B1 | | 11/2001 | Schubert |
| 6,381,294 | B1 | | 4/2002 | Britton |
| 6,464,584 | B2 | | 10/2002 | Oliver |
| 6,506,115 | B1 | | 1/2003 | Mothwurf |
| 6,532,297 | B1 | | 3/2003 | Lindquist |
| 6,540,602 | B2 | | 4/2003 | Adams et al. |
| 6,567,159 | B1 | | 5/2003 | Corech |
| 6,572,474 | B2 | | 6/2003 | Rudd |
| 6,581,747 | B1 | | 6/2003 | Charlier et al. |
| 6,592,445 | B2 | | 7/2003 | Lee |
| 6,629,591 | B1 | | 10/2003 | Griswold et al. |
| 6,733,388 | B2 | | 5/2004 | Mothwurf |
| 6,753,830 | B2 | | 6/2004 | Gelbman |
| 6,772,870 | B2 | | 8/2004 | Sugai et al. |
| 6,976,589 | B2 | | 12/2005 | De Raedt et al. |
| 7,004,831 | B2 | | 2/2006 | Hino et al. |
| 7,014,554 | B1 | | 3/2006 | Fletcher et al. |
| 7,066,335 | B2 | | 6/2006 | Aas et al. |
| 2004/0149539 | A1 | | 8/2004 | De Raedt et al. |
| 2005/0155838 | A1 | | 7/2005 | Raedt et al. |
| 2005/0280212 | A1 | | 12/2005 | Blaha et al. |
| 2007/0212996 | A1 | | 9/2007 | Ryou |

FOREIGN PATENT DOCUMENTS

| | | |
|---|---|---|
| AT | 006 546 | 12/2003 |
| CA | 2090073 | 8/1994 |
| CA | 2229054 | 8/1996 |
| CA | 2229053 | 10/1996 |
| DE | 4240886 | 7/1994 |
| EP | 0424355 | 11/1994 |
| EP | 0631260 | 12/1994 |
| EP | 0757582 | 2/1997 |
| EP | 0806020 | 12/1998 |
| EP | 1080348 | 8/2002 |
| EP | 0823041 | 9/2002 |
| EP | 0950989 | 9/2003 |
| EP | 1050024 | 3/2004 |
| FR | 2 749 093 | 7/1998 |
| FR | 2 752 078 | 10/1998 |
| GB | 1 255 492 | 12/1971 |
| GB | 1 571 219 | 7/1980 |
| GB | 2 061 490 | 5/1981 |
| GB | 2 198 274 | 6/1988 |
| GB | 2 203 582 | 10/1988 |
| GB | 2 254 419 | 10/1992 |
| GB | 2 333 632 | 7/1999 |
| IT | 94 A001040 | 12/1994 |
| WO | WO 91/17842 | 11/1991 |
| WO | WO 92/11953 | 7/1992 |
| WO | WO 95/28996 | 11/1995 |
| WO | WO 96/23281 | 8/1996 |
| WO | WO 96/34258 | 10/1996 |
| WO | WO 99/38126 | 7/1999 |
| WO | WO 99/60353 | 11/1999 |
| WO | WO 03/049045 | 6/2003 |
| WO | WO 03/103860 | 12/2003 |
| WO | 2004009256 A1 | 1/2004 |

OTHER PUBLICATIONS

PCT International Search Report for International Application No. PCT/US04/02331 (2 pages).

Cover sheet of 1993 video tape describing the Chipmaster (author unknown).

List of the first Chipmaster Installations (Date of Delivery) (author and date unknown).

Chipmaster Training handouts from Jan. 1994 (author unknown).

Huxley's advertisement for Chipmaster: Huxley's count on the Chipmaster deal, ("Casino World" is distributed in the U.S.) Mar. 1994 (author unknown).

Show report for Chipmaster in Monte Carlo by Christian Pohanka (the inventor), Mar. 23, 1993.

Trial installation of Chipmaster at Holland Casinos, report by Christian Pohanka, Sep. 29, 1993.

Report from Spain regarding Chipmaster by Christina Pohanka, Sep. 26, 1993.

Photograph of first Chipmaster installation at Casino Baden (Austria), Jan. 4, 2004 (photographer unknown).

Photograph of first Chipmaster installation at Holland Casinos, Jan. 4, 2004 (photographer unknown).

Photograph of first Chipmaster installation at Valencia (Spain), Jan. 4, 2004 (photographer unknown).

Photograph of Chipmaster production at VICOMA, Vienna, Jan. 4, 2005 (photographer unknown).

Photographs of Chipmaster in Paulson Booth at Apr. 26-27, 1994 Show (photographer unknown).

Easy Chipper Brochure (author and date unknown).

Easy Chipper Color Computer Model Schematics (author and date unknown).

Chipmaster Brochure (author and date unknown).

* cited by examiner

CHIP SORTING DEVICE

CROSS-REFERENCE TO RELATED APPLICATIONS

This application is a continuation of U.S. patent application Ser. No. 11/004,006 filed Dec. 3, 2004, pending, which is a continuation of International Patent Application No. PCT/AT03/00149 filed May 26, 2003, and published as International Publication Number WO 03/103860A1 on Dec. 18, 2003, which in turn claims priority to Austrian Application No. 359/2002 filed Jun. 5, 2002, now Austrian Patent AT 006 405.

TECHNICAL FIELD

The invention relates to a sorting device for gaming chips and counters, in particular, to gaming chips and counters of different colors.

BACKGROUND

Sorting devices for gaming chips have been known for a long time. GB 2061490 discloses a device that distributes gaming chips that are collected by a transport chain and passed by a feature recognition system, from the chain into appropriate removal units. A disadvantage of this solution is the high space requirement for the chain. A further disadvantage is the high manufacturing costs, because the chain comprises many individual members, each of these members in addition being provided with a spring-loaded pin for distributing gaming chips.

GB 2254419 describes a device in which the gaming chips are first collected by a transport disc and then transferred to a chain, recognized there, and distributed to a removal unit. This arrangement requires less space than the aforementioned device. Nevertheless, it uses resilient elements to retain individual gaming chips, transferred from the transport disc to the chain, in the chain itself. These resilient elements precisely, however, accept only gaming chips with a largely uniform diameter, because gaming chips with a diameter greater than the nominal diameter can be transferred to the chain only at a high load or not at all; gaming chips with a diameter smaller than the nominal diameter cannot be reliably retained and fall out of the chains on the way to distribution to the removal units. The additional chain leads to additional manufacturing costs.

U.S. Pat. No. 6,381,294 discloses a chip-sorting device in which the conveyance of the chips is effected by a chain. This transport means is very expensive to maintain, however.

SUMMARY OF THE INVENTION

This invention avoids these disadvantages and proposes a sorting device of the aforementioned type, which has low manufacturing costs with a low space requirement and with which the gaming chips and counters may have highly different dimensions.

As taught by the invention, these advantages are achieved with a sorting unit of the aforementioned type by means of the characteristic features of some embodiments of the invention.

The proposed measures make it possible to convey and sort chips and counters of different dimensions by means of a cost-effective and simple transport device. The technically expensive and maintenance-intensive insertion of a chain conveyor is not necessary. The sorting device is robust to gaming chips and counters of different size. By the raising of the gaming chips by the ejector and the simultaneous rotation of the transport disc, the chips are automatically lifted out of the transport disc and organized in a removal unit.

Thereby, the features of some embodiments of the invention provide the advantage of a very gentle and careful distribution of the chips and counters into the removal units.

The features of some embodiments of the invention assure that the distribution movement for a single gaming chip or counter is always constant relative to the movement of the transport disc, even when the transport speed changes.

The organization of the gaming chips and counters, in conjunction with the feature recognition system, can be easily programmed and controlled by means of the features of some embodiments of the invention.

Several removal units can be filled simultaneously by means of the features of some embodiments of the invention.

A portion of the sorted gaming chips and counters can be removed from the removal units in a simple manner by means of the features of some embodiments of the invention.

The features of some embodiments of the invention can adjust the number of gaining chips and counters to be removed from the removal units.

To accomplish this, a tilting movement of the removal lever is provided according to some embodiments of the invention.

The removal lever is always proximate to the gaming chips and counters by means of the features of some embodiments of the invention.

By means of the features of some embodiments of the invention, it can be determined when a removal unit has been totally filled, whereupon gaming chips and counters can no longer be sorted into this removal unit.

The conveying speed of the gaming chips and counters in the system is adjusted by means of the characteristic features of some embodiments of the invention.

The characteristic features of some embodiments of the invention describe the preferably employed feature recognition system.

The base frame can be adjusted in height and adapted to the specific table heights by means of the characteristic features of some embodiments of the invention.

DESCRIPTION OF THE DRAWINGS

The invention will now be illustrated in greater detail by the drawing. Here.

DETAILED DESCRIPTION OF THE INVENTION

Figure 1:
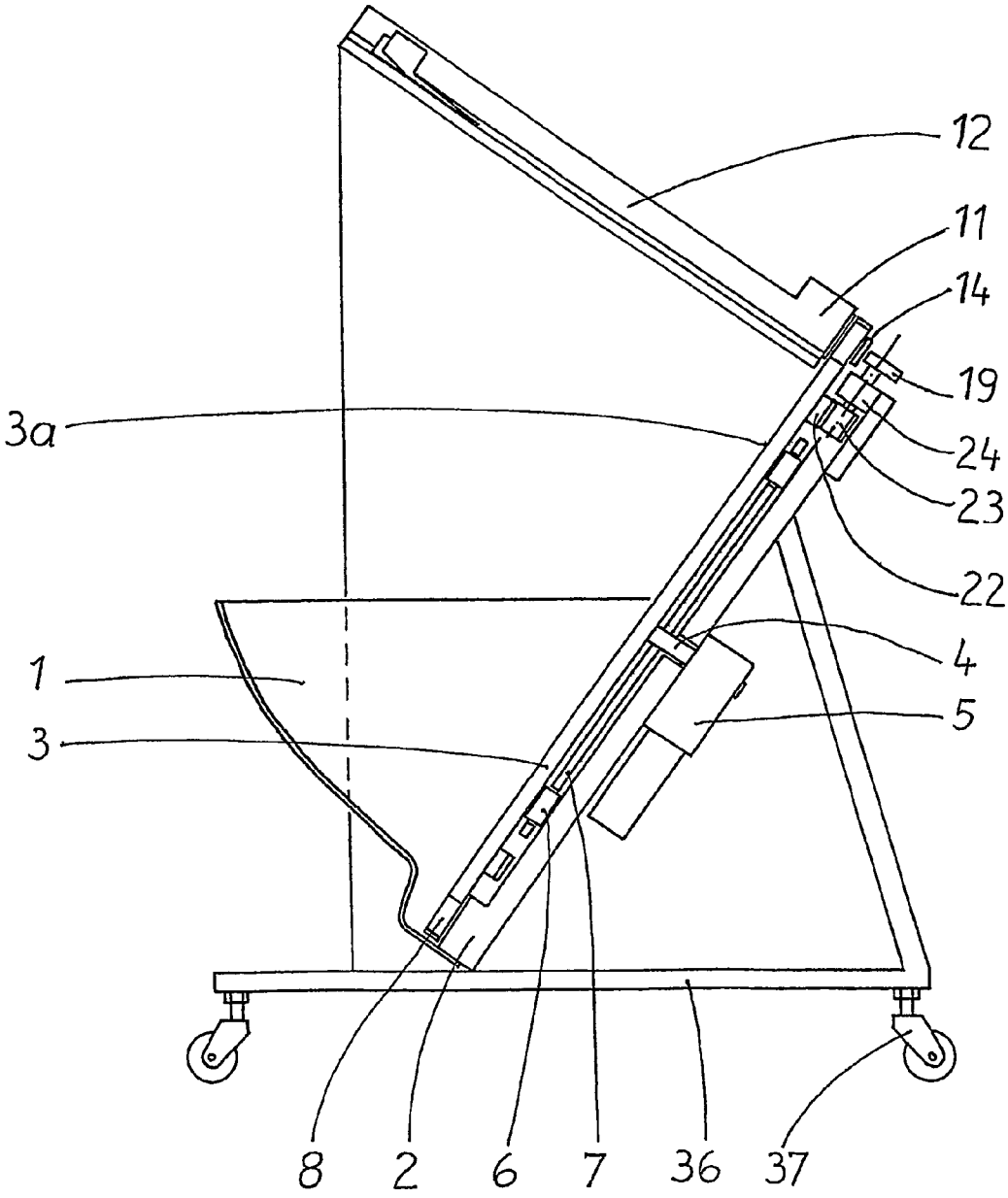
FIG. 1 shows a schematic drawing of a sorting unit of the invention without a housing.

The device consists of an upwardly open collection container 1 for used gaming chips and counters, also called a "hopper," which is fixed to the sloping base plate 2.

The conveying device forms a circular disc 3, the "hopper disc," and is mounted drivably on shaft 4. The shaft 4 is supported by the base plate 2 and is connected to the drive 5.

The hopper disc 3 is supported axially by a plurality of rolling elements 6, which in turn are guided in cage plate 7. This axial support may be omitted, if the central support of the shaft 4 can absorb the axial forces and the hopper disc 3 is made suitably rigid.

Figure 5:
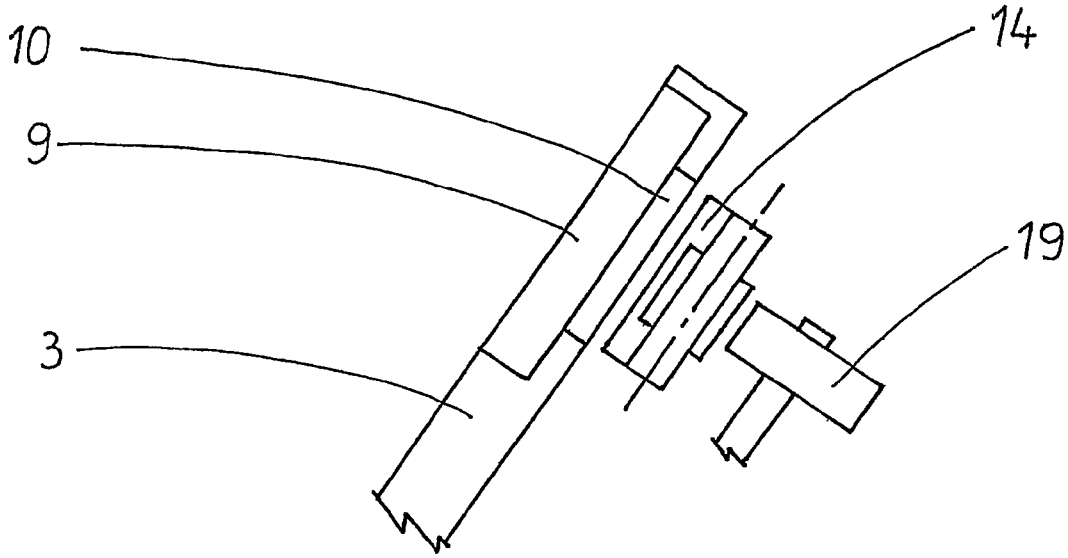
FIG. 5 shows an alternative depiction of a hopper disc.

In use, the gaming chips and counters 27 (FIG. 2) are collected in the hopper 1, where due to gravity they are taken up in the hopper disc 3 at the lowest point of the hopper 1 by circular recesses 8, arranged around the perimeter of the hopper disc 3. The circular recesses 8 (e.g., apertures) have at least the diameter of the largest circular chip or counter that is to be processed. The depth of the circular recesses 8 in the embodiment results from the thickness of the hopper disc 3 and constitutes at least the thickness of the thickest counter. During the use of circular recesses 8 according to FIG. 1, the gaming chips and counters 27 slide on the base plate 2 during the rotation of the hopper disc 3. FIG. 5 shows an alternative collection of chips and counters in blind holes 9. These are open toward the side of the hopper 1 and closed toward the side of the base plate 2. Thereby, the back of the hopper disc 3 must have an annular circumferential groove 10 (FIG. 5), which substantially has the width of the ejector 14 of FIG. 3.

The hopper disc 3 conveys the gaming chips and counters 27, taken up in any order by the circular recesses 8, upward at an angle of approximately 135°, whereby they are passed before a color sensor, which differentiates the chips and counters based on their color combination and size. Depending on chip color and pattern, the sensor conveys a signal to the microprocessor control (not shown) of the chip sorting device. This microprocessor control decides, based on a freely programmable assignment of colors, to which of the removal units 12 each of the conveyed gaming chips and counters 27 is distributed.

Alternatively, recognition of the gaming chips and counters 27 can occur by means of a spectrometer in a feature recognition system, which for differentiation detects the wavelengths of the color codes undetectable by the human eye. To accomplish this, the gaming chips and counters 27 must be provided with such color codes.

After recognition, the gaming chips and counters 27 are distributed into the removal units 12. This area extends at about 90° to the hopper disc 3.

Figure 4:
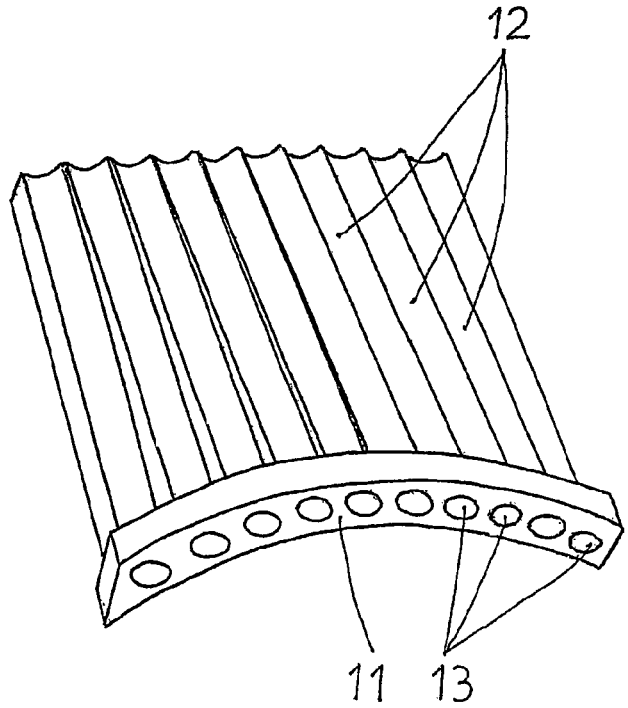
FIG. 4 shows a possible spatial form of the removal units.

FIG. 4 shows the transfer element 11, which is designed substantially as an arc-like sector and has a number of apertures 13, in which the different gaming chips and counters 27, sorted cleanly per aperture 13, are distributed from the hopper disc 3 into removal units 12. Ten apertures 13 are used in the exemplary embodiment.

Figure 2:
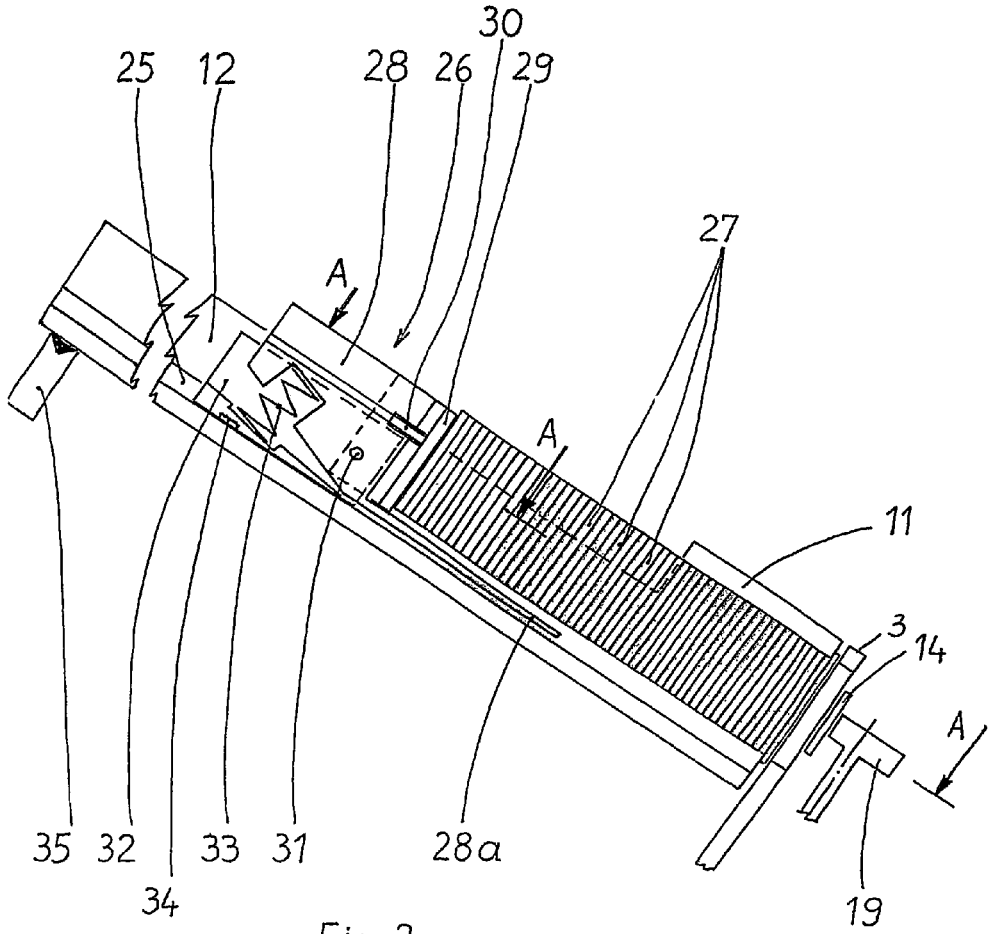
FIG. 2 shows a cross-section through a removal unit.
Figure 3:
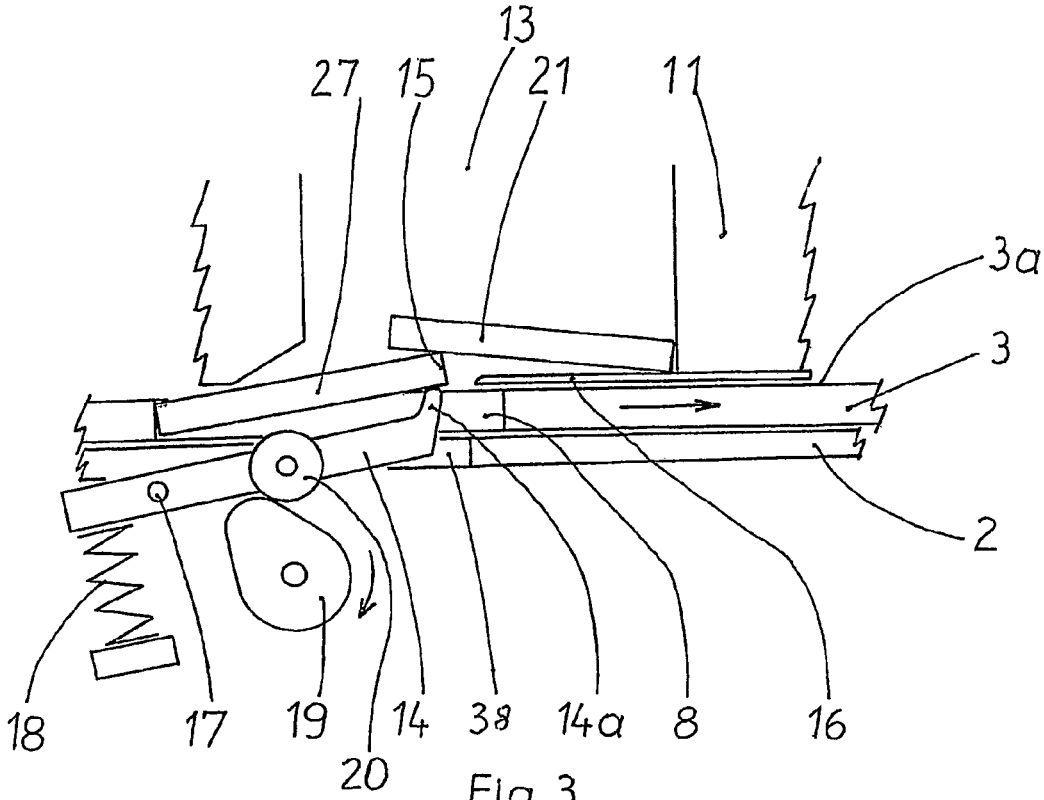
FIG. 3 shows a cross-section through the chip and counter distribution unit along section line A-A of FIG. 2.

The actual distribution of gaming chips and counters is readily evident from FIG. 3, which shows a cross-section along the section line A-A of FIG. 2 through one of the apertures 13 in the transfer element 11. Each of the apertures 13 is assigned an ejector 14, which after activation is inserted into the recesses 8 through a slit 38 in the base plate 2 and raises the corresponding gaming chip or counter 27 above the face 3*a* (see also FIG. 1) of hopper disc 3 during the movement of the hopper disc 3. The ejector 14 is mounted so that it swivels around the shaft 17 and is pushed against the cam 19 via spring 18 causing contact of gaming chip or counter 27 by arm 14*a*. To enable a wear-free rolling of the cam 19 on the ejector 14, the ejector 14 can be provided expediently with a roller 20.

By means of the continuous movement of the hopper disc 3, the gaming chip or counter 27 (FIG. 2) is pushed over the blade 16, where if finally rests. If another counter 21 is located on the blade 16, it is unavoidably raised by means of the lifting motion of the gaming chip or counter 27, so that gaming chip or counter 27 comes to lie finally under counter 21. This process is repeated as long as gaming chips or counters 27 of the same type are being conveyed, so that the removal units 12 (FIGS. 1 and 2) fill with counters.

FIG. 4 shows the removal units 12 directly adjacent to the transfer element 11, the removal units 12 that run next to one another expediently from the arc-like arrangement in the area of the transfer element 11 to a straight or nearly straight arrangement facilitate the easy removal from all sides of gaming chips or counters 27 (FIG. 2) deposited herein.

FIG. 1 shows the drive of the cam 19. On the side facing away from hopper 1 of the hopper disc 3, there is an annular ring gear 22 that drives a pinion 23 associated with a cam 19. The microprocessor control of the chip sorting device actuates a magnetic coupling 24, associated with the cam 19, and thereby creates a connection between the pinion 23 and the cam 19 for a cam rotation. This assures that the ejector 14 always performs the same movement relative to the hopper disc 3, independently of the conveying speed of hopper disc 3.

If a jam were to occur during the transfer of the gaming chips and counters 27 into the removal units 12, a short return motion of the hopper disc 3 is provided. To recognize a jam, the current of the drive 5 can be monitored, or the movement of the hopper disc 3 can be queried directly via a suitable sensor.

To increase the conveying performance and simultaneous reduction of wear on all moving parts of the machine, adjustment of the conveying speed of the chip sorting device to the quantity of counters to be sorted in each case is recommended. The speed can be set depending on whether and how many free recesses 8, i.e., not filled with gaming chips or counters 27, in the hopper disc 3 can be detected by a counter recognition system.

The removal units 12 for sorted gaming chips and counters 27 can be seen in FIG. 2 and consist substantially of upwardly open chip transporters, each respectively provided with a central groove 25. For the expedient removal of gaming chips and counters 27 from the removal units 12, a special device is provided, a "cutter" 26, which glides downward in one of the grooves 25 by means of gravity and thus constantly abuts the reserve gaming chips and counters 27 in the removal units 12. The cutter has an L-shaped lever 28, the thin arm 28*a* of which lies underneath the gaming chips and counters 27. At the same time, a stop 29 always abuts the gaming chips and counters 27 and in turn is supported by lever 28 via an adjusting screw 30. The lever 28 and stop 29 are connected in a swiveling manner by means of the shaft 31 with the body 32 gliding within the groove 25. Through pressure applied in the direction of arrow A, a predetermined quantity, preferably 20 pieces, of gaming chips or counters 27 can be raised by the lower arm 28*a* of the L-shaped lever 28 and are thus freely removable from the total quantity of gaming chips or counters 27.

The quantity of gaming chips and counters 27 that can be lifted by the cutter 26 can be finely adjusted or matched to the precise thickness of the gaming chips and counters 27 via the adjusting screw 30.

The use of a pressure spring 33 assures that the thin leg of the L-shaped lever 28 always remains underneath the gaming chips or counters 27, but this is not absolutely required.

In order to prevent the distribution of more gaming chips or counters 27 into one of the removal units 12 than can be accommodated by its stack length, every removal unit 12 is provided with a sensor 35. As soon as the cutter 26 reaches its endpoint, the sensor 35 sends a signal to the microprocessor control, which then no longer ejects gaming chips and counters 27 into the particular channel. The sensor 35 can, for example, be either an optical or magnetic sensor. To that end, a permanent magnet 34 must be provided in the bottom of the cutter 26.

The chip sorting device can be designed to be adjustable with simple means to different table or operator heights. As is evident from FIG. 1, the casters 37 are attached to the base frame 36 to be adjustable in height.

The invention claimed is:

1. A casino chip sorting device, comprising:

a transport disc with multiple recesses for collecting individual chips;

a drive operably coupled to the transport disc for rotating the transport disc;

an ejector extendable into a recess from beneath the transport disc to move a disc that is in the recess;

a cam selectively rotatable by the drive to push the ejector into the recess; and a blade having an upper surface positioned to receive a casino chip moved by the ejector;

wherein a processor associated with the casino chip sorting device is programmed to recognize a jam.

2. The casino chip sorting device of claim 1, wherein a motor provides power to the drive and power in the motor is monitored by the processor to detect the jam.

3. The casino chip sorting device of claim 1, wherein the individual chips are sensed in the transport disc and the sensor is assessed to determine the presence of a jam.

4. The casino chip sorting device of claim 1, wherein at least one function of the transport disc is monitored to determine the jam.

5. The casino chip sorting device of claim 1, wherein a drop in activity of the casino chip sorting device is sensed to determine the existence of the jam.

6. The casino chip sorting device of claim 5, wherein a drop in activity of the casino chip sorting device comprises a drop in activity of the transport disc.

7. The casino chip sorting device of claim 1, wherein the processor is adapted to provide for a short return motion of the transport disc after detection of a jam.

8. The casino chip sorting device of claim 1, wherein the processor is adapted to direct a return motion of the transport disc upon recognition of the jam.

9. A sorting device for the sorting of gaming chips, comprising:

a base frame;

a collection container;

an oblique transport disc for separating and receiving the gaming chips adjoining the collection container;

a gaming chip characteristic identification system positioned adjacent the oblique transport disc;

a transfer device for distributing the gaming chips to removal units according to characteristics identified in the gaming chip characteristic identification system, the removal units having a substantially U-shaped cross-section;

a radially external region of the oblique transport disc containing recesses into which the received gaming chips are separated;

at least one ejector that can be inserted at least partially from one side of the oblique transport disc into the recesses to lift an edge of the gaming chips therein above a front face of the oblique transport disc lying opposite the at least one ejector;

a blade associated with a removal unit positioned to slide under a gaming chip with a lifted edge and receive the gaming chip with a lifted edge thereon;

wherein a side of the oblique transport disc not adjacent to the collection container has a cogwheel; and a processor associated with the sorting device programmed to recognize a jam.

10. The sorting device of claim 9, further comprising a coupling adjacent the cogwheel adapted for selective actuation of the at least one ejector responsive to movement of the cogwheel.

11. The sorting device of claim 9, wherein the processor is programmed to provide for a return motion of the oblique transport disc responsive to detection of a jam.

12. The sorting device of claim 11, wherein the coupling comprises a magnetic coupling, and at least one removal unit and at least one ejector are aligned with a pinion selectively coupleable to the cogwheel by the magnetic coupling.

13. The sorting device of claim 11, wherein at least one removal unit comprises an L-shaped removal lever including a first arm, which first arm is in a groove that runs a length of a floor of the at least one removal unit and extends under an area of the at least one removal unit where gaming chips removed from the oblique transport disc are supported.

14. The sorting device of claim 13, wherein the L-shaped removal lever comprises a second arm relatively shorter than the first arm and the L-shaped removal lever is pivotally mounted to an axle oriented perpendicular to the length of the floor of the at least one removal unit and spaced therefrom.

15. The sorting device of claim 14, further comprising a spring biasing the second arm of the L-shaped removal lever against the removed gaming chips in the at least one removal unit.

16. The sorting device of claim 13, wherein the gaming chip characteristic identification system utilizes sensors to differentiate at least one of size and color of gaming chips.

17. The sorting device of claim 9, wherein a drop in activity of the sorting device is sensed to determine the existence of the jam.

18. The sorting device of claim 17, wherein a drop in activity of the sorting device comprises a drop in activity of the oblique transport disc.

19. The sorting device of claim 9, further including a motor to provide power to rotate the oblique transport disc and monitored power in the motor is used by the processor to detect the jam.

20. The sorting device of claim 9, wherein at least one removal unit has a sensor associated therewith to detect when that removal unit is full of gaming chips.

* * * * *